United States Patent [19]

Osrow

[11] 4,239,409

[45] Dec. 16, 1980

[54] BRUSH ASSEMBLY WITH PULSATING WATER JET DISCHARGE

[75] Inventor: Leonard Osrow, Great Neck, N.Y.

[73] Assignee: Osrow Products Co., Inc., Glen Cove, N.Y.

[21] Appl. No.: 934,999

[22] Filed: Aug. 18, 1978

[51] Int. Cl.[3] ..... A61H 9/00

[52] U.S. Cl. ..... 401/281; 401/290

[58] Field of Search ..... 401/270, 271, 280, 281, 401/282, 284, 290, 43; 128/66, 64

[56] References Cited

U.S. PATENT DOCUMENTS

| | | | |
|---|---|---|---|
| 1,038,656 | 9/1912 | Reuter | 128/66 |
| 1,567,076 | 12/1925 | Patty | 401/43 |
| 1,948,167 | 2/1934 | Cornwell | 128/66 |
| 2,243,275 | 5/1941 | Ewan | 401/43 X |
| 2,304,616 | 12/1942 | Watson | 128/66 |
| 2,418,360 | 4/1947 | Matlack et al. | 401/43 X |
| 2,521,929 | 9/1950 | McNeill, Jr. | 401/43 |
| 3,910,265 | 10/1975 | Coleman | 401/271 X |

FOREIGN PATENT DOCUMENTS

| | | | |
|---|---|---|---|
| 329658 | 9/1935 | Italy | 128/66 |
| 436216 | 11/1967 | Switzerland | 401/43 |

*Primary Examiner*—E. H. Eickholt

*Attorney, Agent, or Firm*—Kirschstein, Kirschstein, Ottinger & Cobrin

[57] ABSTRACT

A brush assembly, attachable to a pressurized water line, produces at least two alternating pulsating jet discharges of water. One discharge comprises a linear stream and the other comprises a spray. A nozzle housing detachably mounted on the head of the brush assembly is employed to deliver the intermittently, interrupted or pulsating water jet discharges. Water passing through the brush assembly and the housing drives a turbine blade assembly in the housing. In turn, the turbine blade assembly rotates rotatable valve member at a rotary speed dependent upon the initial pressure of water entering the brush assembly. Water flows through an inlet of the housing through two flow paths. In one flow path, water flows through a valve port in the valve member and out through the discharge orifices in the housing. In the second flow path, water flows around the valve member and out through the discharge orifices and housing. The rotation of the valve member cyclically interrupts water communication between the inlet and the discharge orifices along the first flow path. The configuration of the rotating valve port, the arrangement of the orifices and the second flow path maintain back pressure at the rotating valve port at a substantially constant level regardless of the rotary position of the rotating valve port.

17 Claims, 9 Drawing Figures

FIG. 6
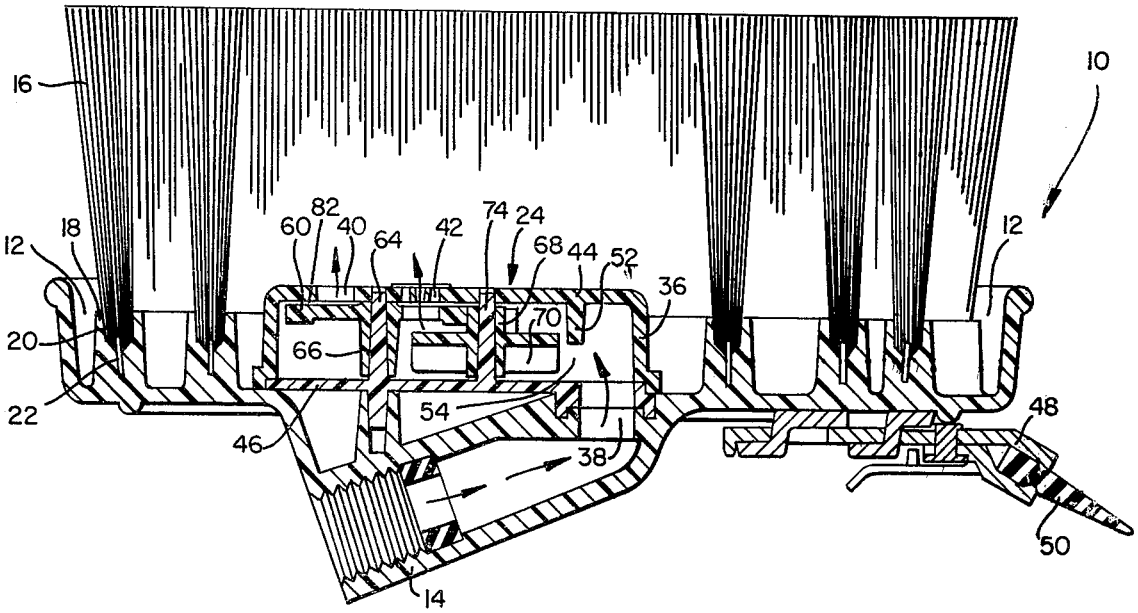
FIG. 7
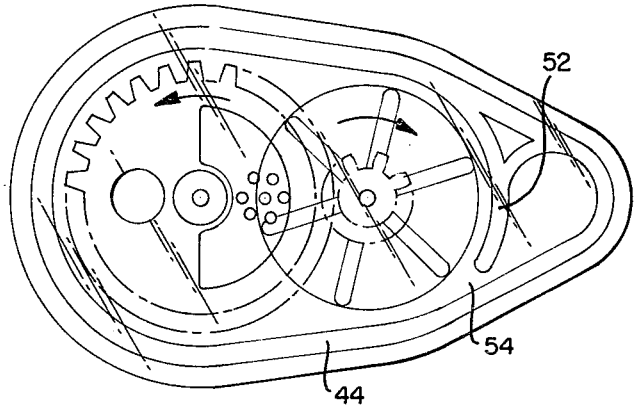
FIG. 9
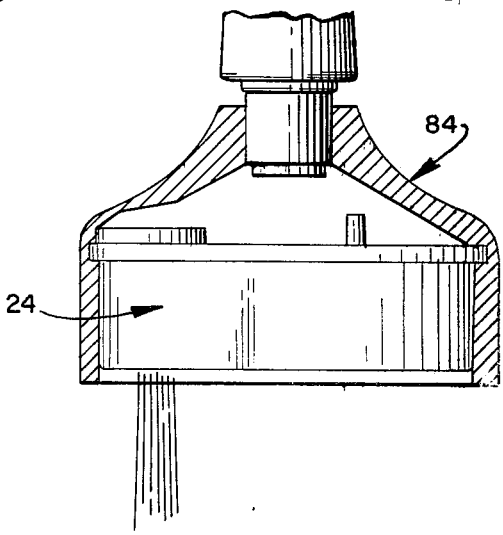
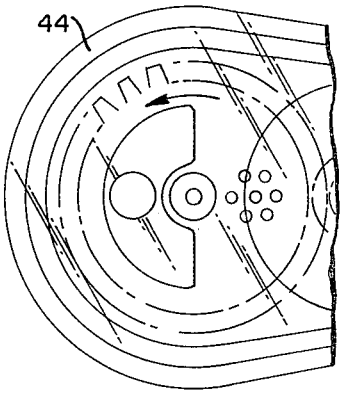
FIG. 8

BRUSH ASSEMBLY WITH PULSATING WATER JET DISCHARGE

BACKGROUND OF THE INVENTION

1. Field of the Invention

This invention relates to a pulsating waterjet discharge device for attachment to a pressurized water line. More particularly, this invention relates to a brush assembly having a pulsating water jet discharge device for producing pulsating jet discharges of water which clean the outer surfaces of automobiles and dislodge particles of dirt with massaging action on the surface of an automobile.

2. Description of the Prior Art

It is a well-known fact that a massaging effect can be created by a pulsating stream of water. Many efforts have been made in an attempt to provide a spray nozzle which will discharge an intermittent or pulsating spray when supplied by water from a constant source of pressure. Such pulsating stream devices have found application in the field of irrigation, personal hygiene and dentistry, such as in oral hygiene devices for massaging the teeth and gums. The effect of a pulsating stream of water is most conveniently achieved in these environments by intermittently interrupting the streams discharged from the nozzle orifices.

One of the problems of these devices has been that the intermittent opening and closing of the nozzle orifices to achieve the desired interruption of pulsation of the water stream results in a cycling varying back pressure as the orifices are alternately opened and closed. This creates a water hammer in the water pipe system. The present invention is especially directed to the provision of a brush assembly with a pulsating water jet discharge device which produces at least two pulsating or intermittently interrupted water jet discharges, one preferably being a linear stream and the other being a spray, in sequential alternate manner, with no variation in back pressure exerted by the discharge device, thereby eliminating water hammer.

SUMMARY OF THE INVENTION

1. Purposes of the Invention

It is an object of this invention to provide a novel and advantageous brush assembly having a pulsating water jet discharge device by means of which pulsating jets of water may be used for cleaning or dislodging particles of dirt from the surfaces of automobiles.

It is also an object of this invention to provide a nozzle containing a pulsating water jet discharge device by means of which pulsating jets of water may be delivered against the body, for the stimulation or curative effects to be secured thereby.

Another object of this invention is to provide a brush assembly having a pulsating water jet discharge device which is actuated by the pressure of water fed into the brush assembly and device and wherein two different types of water discharges are produced, one type being a pulsating stream of water and the other type being a pulsating spray of liquid jets, the two types being sequentially discharged from two separate outlets in the discharge device.

Still another object of this invention is to provide a brush assembly having a pulsating water jet discharge device which can be made inexpensively and yet operate very efficiently.

A further object of this invention is to provide a brush assembly having a pulsating water jet discharge device configured and adapted to control the rate of pulsation of water jets from the discharge orifices independently of the pressure of water supplied to the discharge brush assembly.

Another object of this invention is to provide a brush assembly having a pulsating device for a water outlet, which when producing pulsating water jet discharges, mitigates against the development of a water hammer in the supply line.

These and other objects and advantages of the present invention will become evident from the description which follows.

2. Brief Description of the Invention

Briefly, this invention relates to a brush assembly which comprises:

- a brush block member having a face onto which are mounted a multiplicity of bristles and the discharge device, the bristles being situated on and covering the peripheral portion of the face, the discharge device being situated on and covering a central portion of the face within the bristles; the discharge device comprises a hollow housing, the housing having: (a) a first water inlet at one end and (b) means comprising at least two discharge orifices spaced apart from said first inlet in a symmetrical pattern about an axis;
- a valve member mounted in the housing for rotation about the axis, the valve member having a valve port establishing fluid communication sequentially between the first inlet in one of said orifices, then with portions of both of the orifices, then with the other of the orifices and then with portions of both orifices in a repeating cycle;
- means in the housing defining a water flow passage between the first inlet and the valve port for conducting water from the first inlet to the valve port, the water flow passage including a constricted passageway in communication with the first inlet;
- a second water inlet situated in the brush assembly and in fluid communication with the first water inlet, the second inlet including means for attachment to a pressurized water line;
- turbine means in the housing and situated in the water flow passage immediately downstream of the constricted passageway; and
- means kinematically connecting the turbine means to the valve member for rotating the valve member in response to the flow of water through the flow passage.

The two discharge orifices are preferably different from one another. One of the orifices preferably is defined by a symmetrical group of apertures. The other one of the discharge orifices preferably is defined by a single aperture. The cross-sectional area of the two different types of orifices preferably is substantially equal. Moreover, the two different types of discharge orifices should be separated a distance sufficient to subject a target of the water jet discharges from the two different orifices to sequentially alternating and/or overlapping impingement of the pulsating water jets therefrom. In a preferred embodiment of the present invention, one of the discharge orifices provides a pulsating solid stream of water and the other of the discharge orifices provides a pulsating spray of water.

Typically, the brush assembly of the present invention is connected to a water line operating at City water pressure, which is about 40 psig. The pulsating water jet discharge device is configured and adapted so as to control rotation of the valve member based on feeding water to the brush assembly from City water lines. The valve member including gear means driven by gears mounted on said turbine means, the gear ratios being selected to provide a rate of rotation for the valve member between about 50 and about 600 revolutions per minute in response to the flow of water through the flow passage. The constricted passageway in the flow passage accelerates and directs the flow of water through the housing so that it tangentially impinges on turbine blades of turbine means, thus causing rotation of the turbine means. A pinion gear coaxially mounted on the turbine means rotates as the turbine blades rotate. The pinion gear meshes with a drive gear located at the rim or periphery of a circular valve member thereby causing counter-rotation of the valve member, which typically has the shape of a wheel.

Rotation of the valve member cyclically interrupts flow of water passing through the discharge orifices of the water jet discharge device. This cyclic interruption of the water flow creates a pulsating effect. The jet stream or spray type pattern is provided by the shape and configuration of the two different types of discharge orifices. A second water flow path is provided in the water jet discharge device which bypasses the valve member. Water entering the inlet flows tangentially along the side walls of the device and is discharged through the two discharge orifices without flowing through the valve port in the valve member. The cyclic opening of the valve port of the valve member permits fluid communication between the first and second fluid flow paths. Indeed, the water exiting the valve port is ejected out of the jet discharge device through one of the discharge orifices with such force that the comingling of the waters from the two fluid paths creates a turbulent swirling flow which adds to the pulsating and massaging effect of the water stream and/or spray being discharged through the discharge orifices.

This invention accordingly consists in the features of construction, combination of elements and arrangement of parts which will be exemplified in the brush assembly and pulsating water jet discharge devices hereinafter described and in which the scope of application will be indicated in the appended claims.

BRIEF DESCRIPTION OF THE DRAWINGS

In the accompanying drawings in which are shown several embodiments of the present invention:

FIG. 6 is a sectional elevation view of the discharge device installed in the upper face of the brush assembly;

FIG. 7 is a plan view of the discharge device showing rotation of the valve member in a direction counter to the rotation of the turbine means;

FIG. 8 is a plan view showing the valve member of FIG. 7 rotated by 180°; and FIG. 9 is a sectional elevation view of a nozzle housing containing the discharge device.

DETAILED DESCRIPTION OF THE DRAWINGS

Figure 1:
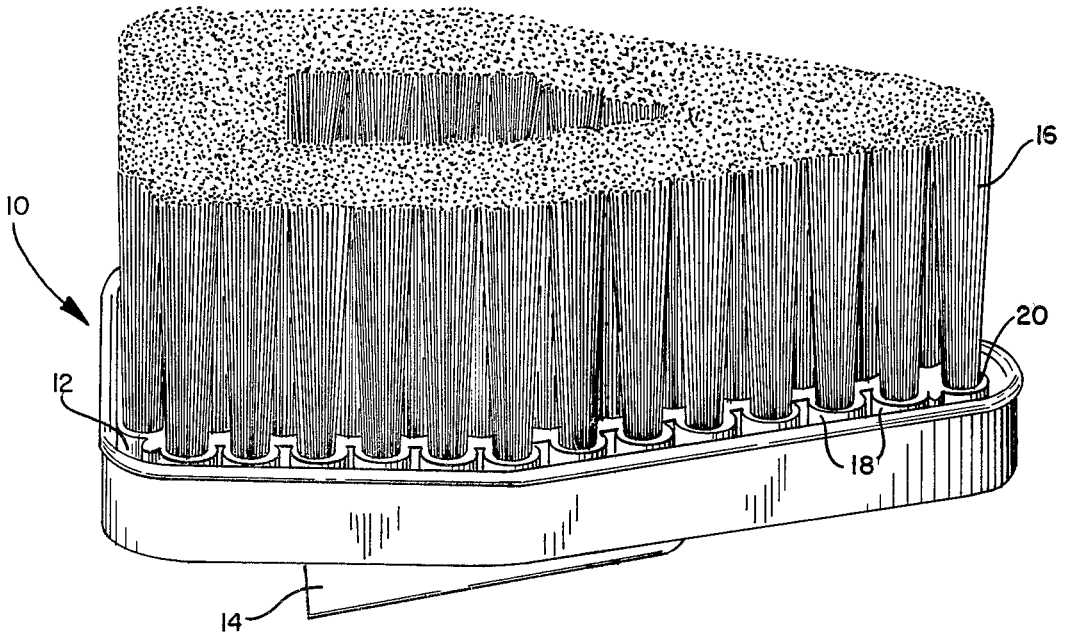
FIG. 1 is a perspective view of the brush assembly of the present invention showing a plurality of bristles mounted on the upper face of the brush assembly.

Referring now in detail to the drawings in which like reference characters designate like parts, the pulsating water jet discharge device of the present invention, while generally applicable to pressurized fluid lines, is particularly designed for use in a pressurized water line in conjunction with a brush assembly. As typical of such usage, the pulsating water jet discharge device has been illustrated in conjunction with a brush assembly of FIGS. 1, 2 and 6. Alternatively, the pulsating water jet discharge device of the present invention may be incorporated into a unitary or separate shower or spray head, nozzle, faucet or other suitable outlet or outlet attachment for controlling the character and volume of the discharge therefrom. The pulsating water jet device has been further illustrated as having the related or associated outlet or outlet attachment, a showerhead having a perforated plate or other suitable outlet or discharge end and supplied with water under pressure (not shown) in FIG. 9. In both embodiments, water through a supply line is supplied under pressure which is under the control of conventional mixing or other regulating valving (not shown).

Figure 2:
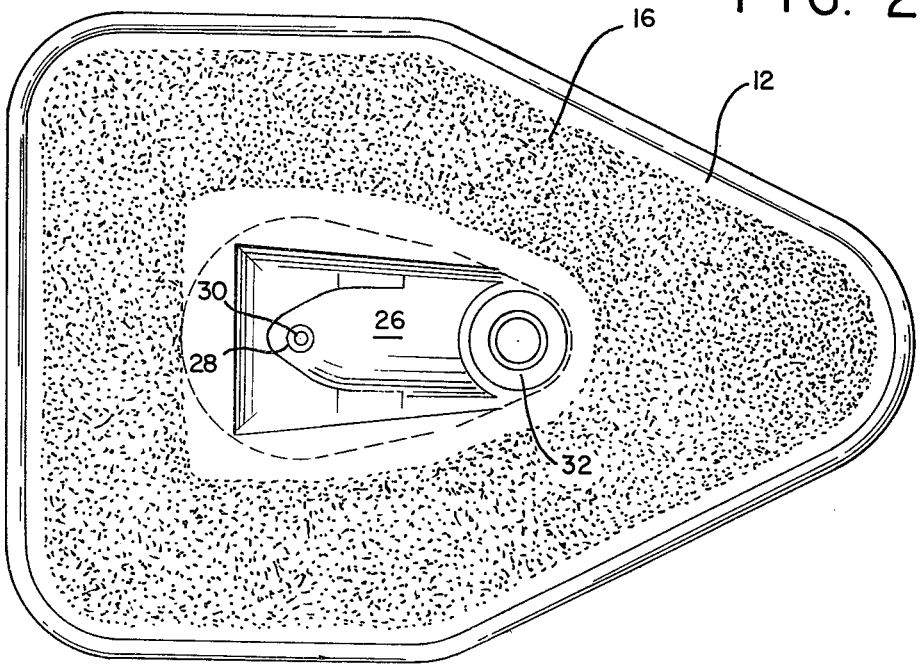
FIG. 2 is a plan view of the upper face of the brush assembly of FIG. 1 with the pulsating water jet device removed.

Referring now to FIGS. 1 and 2, there is shown a brush assembly 10, according to the present invention having an upper face 12, an inlet coupling 14 below its upper face 12 and a multiplicity of bristles 16 mounted in substantially parallel alignment on the peripheral portion of the upper face 12. Situated on the peripheral portion of the upper face 12 is a ledge 18 having three rows of bores 20 therein, one of the ends of the bores 20 is secured via staples 12 into the base of the bores 20. As shown in FIG. 1, there are three rows of bristles symmetrically aligned and closely spaced together along the upper face 12 of the brush assembly 10. There can be more or fewer rows of bristles or a closer spacing and density thereof without affecting the novel features of the present invention.

The inlet coupling 14 may comprise a female coupling or fitting designed to mate with a male coupling or fitting (not shown) at the end of a wand, which, in turn, is connected to a hose (not shown).

The central area of the upper face 12 of the brush assembly 10 is clear of bristles 16. A pulsating jet discharge device 24 is shown mounted in the central portion of the upper face 12 of the brush assembly 10.

Referring now to FIGS. 2 and 6, the central portion of the face 12 of the brush assembly 10 is provided with a well or depression 26 for receiving the water jet discharge device 24. A boss 28 with a blind bore 30 is situated within the well 26 and extends outwardly therefrom. The boss 28 is adapted to receive a spindle therein. A circular groove 32 also is situated within the well 26 and is adapted to receive an annular flange 34 therein as subsequently described. The location and configuration of the groove 32, the well 26 and the boss 28 are adapted to matingly receive the pulsating water jet device 24.

Figure 3:
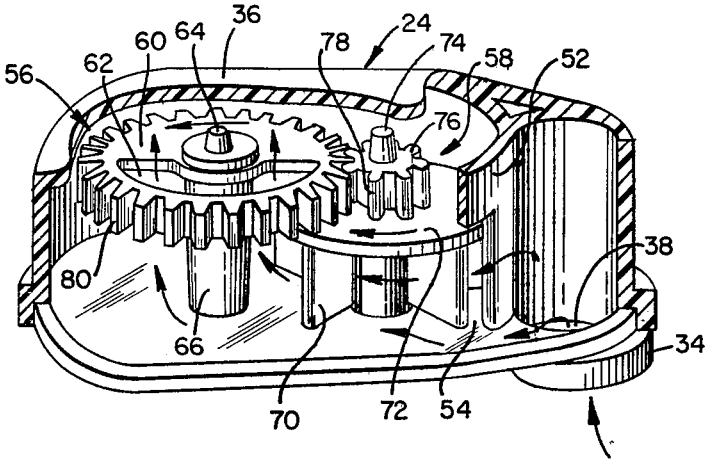
FIG. 3 is a sectional perspective view of the pulsating water jet discharge device with the front part of the device cut away.
Figure 4:
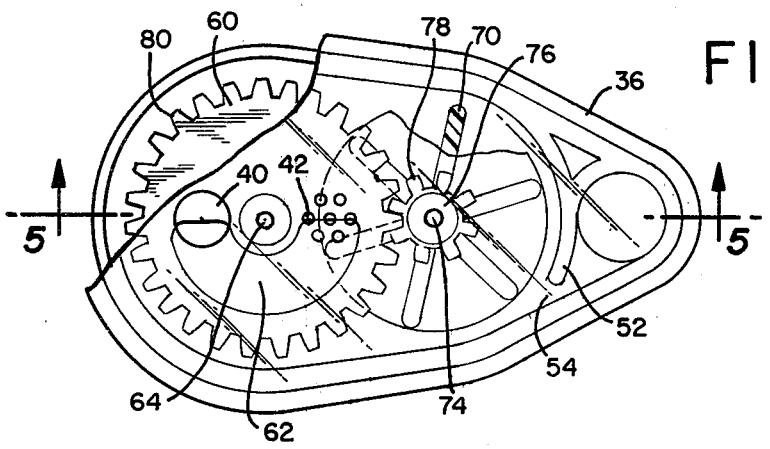
FIG. 4 is a plan view of the discharge device of FIG. 3 with part of the housing of the device cut away.
Figure 5:
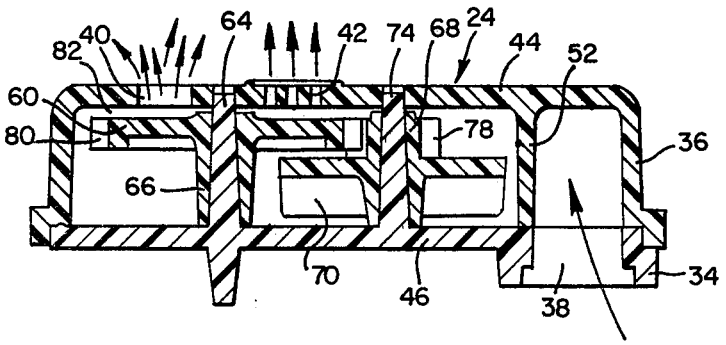
FIG. 5 is a sectional elevation view of the discharge device taken substantially along the line 3—3 of FIG. 4.

Referring now to FIGS. 3, 4 and 5, there is shown the pulsating water jet discharge device 24 comprising a hollow housing 36 having an inlet 38 and two outlets 40, 42. The inlet 38 is in fluid communication with the inlet coupling 14 of the brush assembly 10. The hollow housing 36 has an upper wall 44 and a lower wall 46 which are oppositely facing.

The annular flange 34 depends from the lower wall 46 and has a hollow core defining part of the inlet 38 into the housing 36. The flange 34 seats within the groove 32 when the housing 36 is mounted upon the face 12 of the brush assembly 10. Also shown in FIG. 6 is an optional feature of the brush assembly 10, a flange 48 situated below the face 12 and at one end thereof adapted to releasably hold a squeegee 50. The squeegee 50 may be used in conjunction with the bristles 16 and the water jet discharges to clean the surface of an automobile.

In and integral or rigid with the housing 36 is a wall portion 52 which extends from the upper wall portion 44 toward the lower wall portion 46. Moreover, the wall portion 52 extends from one side wall of the housing 36 to the oppositely facing side wall of the housing 36 except for a lower portion thereof near one of the side walls of the housing 36 which is omitted thereby to form a constricted passageway 54 through which water entering the inlet 38 is directed. The effect of the constricted passageway 54 is to create a nozzle that channels the flow of water entering the inlet 38 at a predetermined flow rate.

A valve member 56 and its driving turbine or impeller 58 are mounted within the hollow interior of the housing 36, having a downstream end adjoining and confronting the cross wall 52 and extending upstream therefrom, axially of the housing 36, toward the latter's upstream end. The preferred valve member 56 is formed of relatively rotatable annular or hollow outer and inner elements concentric with each other. The outer element comprises a cylindrical sleeve or hollow stem having an annular wheel-like member 60 mounted at one end thereof. The wheel-like member 60 has a radial port 62 therein extending over about 180°. The inner element comprises an externally cylindrical hub or core 64 (in the form of a spindle) received in the sleeve 66. Preferably, the sleeve 66 is the rotary valve member or rotor and the hub 64 is the stationary element or stator. The radial port 62 in the wheel-like member 60 aligns with the discharge orifices, as more fully discussed subsequently, intermittently, periodically or at intervals during its rotation relative to the discharge orifices and alternately passes and blocks flow from the housing 36 to the discharge orifices 40, 42 along a first fluid flow path, as more fully described subsequently.

The turbine, turbine wheel or impeller 58 responsible for turning the radially ported wheel-like member 60 of the valve member 56 is also mounted within the housing 36 upstream or in advance of the valve member 56. Preferably, the rotor or impeller 58 is located in a plane normal to the axis traversing the upper and lower walls 44, 46 of the housing 36. The impeller 58 also is preferably formed of a relatively rotatable annular or hollow outer and inner elements mutually rotatable with one another. The outer element comprises a cylindrical sleeve or hollow stem 68 having blades 70 extending radially therefrom. In parallel axial alingment with the valve member 56 and rotating/turning therewith in line with the direction of flow of water into the housing 36 through the inlet 38, the impeller 58 is driven or powered by a tangential force derived from directing or passing the entering water through the constricted passageway 54 onto and normal to the tops of the circumferentially spaced, radially projecting, peripheral blades or vanes 70, angled or inclined or sloping opposite the direction of rotation of the impeller 58.

As the valve member 56 is most effective turning at a rate between about 50 and about 600 revolutions per minute, the gear ratios and/or the inclination of the turbine blades 70 are preselected to produce a speed for the valve member 56 within that range under the line pressure/pressures for which the particular pulsating device 24 is designed.

The driving connection between the impeller 58 and the valve member 56 preferably is direct so that the two elements 56 and 58 rotate simultaneously.

As illustrated in FIGS. 7 and 8, rotation of the impeller 58 in a clockwise direction causes the valve member 56 to rotate in a counterclockwise direction. The rotation of the valve member 56 cyclically brings the discharge orifices 40 and 42 in alignment with the valve port 62 allowing water to exit the housing 36 along the first fluid flow path. As previously described, the flow of water is cyclically interrupted. As the valve port 62 traverses a single cycle, first, the discharge orifice 42 and the valve port 62 are aligned (see FIG. 7) and the flow of water along the first flow path is blocked by the valve member 56. The flow of water along the first flow path can continue only through the discharge orifice 42. Second, the rotation of the valve member 56 aligns the ends of the valve port 62 with portions of each of the discharge orifices 40 and 42 while the remaining portions thereof are blocked off by the valve member 56. The flow of water along the first flow path continues at all times then through portions of each discharge orifice. Third, after rotating 180° from its FIG. 7 disposition, the discharge orifice 40 and the valve port 62 are aligned (see FIG. 8) and the flow of water along the first flow path is blocked by the valve member 56. The flow of water along the first flow path can continue only through the discharge orifice 40. Fourth and lastly, the rotation of valve member 56 again aligns the ends of the valve port 62 with portions of each of the discharge orifices 40 and 42 while the remaining portions thereof are blocked off by the valve member 56. The flow of water along the first fluid flow path continues at all times. When the valve member has rotated 360°, a new cycle begins, which is a repetition of the cycle described hereinabove. During each cycle, the portions of the discharge orifice 40 and/or the discharge orifice 42, which are aligned with the valve port 62 always total a cross-sectional area substantially equivalent to one of the discharge orifices which mitigates the possibility of a water hammer developing in the first flow path.

A turbine plate 72 is transversely mounted on the upper edge surface of the blades 70. Coaxially mounted with the turbine plate 72 on a spindle 74 is a pinion gear 76. The spindle 74 is situated on an axis traversing the upper and lower wall portions 44, 46 of the housing 36. The pinion gear has teeth 78 which mesh with teeth 80 forming and situated around the perimeter of the wheel-like member 60 fixed to the valve member 56. The lower wall 46 of the housing 36 has integral or rigid therewith or fixed thereto at least two spindles 64, 74 upstanding therefrom, one 74 close to the inlet end of the housing 36, and the other 64 close to the outlet end of the housing 36. Referring to FIGS. 5 and 6, it can be seen that the spindle 64 extends downwardly beyond the lower wall 46 and when the pulsating water jet device 24 is mounted on the face 12 of the brush assembly 10, the portion of the spindle 64 extending exteriorly of the housing 36 fits into the boss 28 in the well 26.

The diameter of the impeller 58 is smaller than the perimeter of the housing enclosing it and the outside diameter of the valve member 56 is also smaller than the perimeter of the housing enclosing it. When the inlet 14 is connected via a wand (not shown) to a pressurized fluid line, such as water hose line, the water enters the inlet tube 38, passes through the constricted passageway 54 in the direction of the arrows shown in FIG. 3 to impinge normally upon the blades 70 and rotate the impeller 58 at a high speed. A substantial volume of the water passing through the constricted passageway 54 will not only flow between and act on the turbine blades 70, but also will flow freely therebeyond in the annular space between the impeller 58, the valve member 56 and the side walls of the housing 36. Water passing through the constricted passageway 54 and driving the turbine blades 70 passes either through the valve port 62 when aligned with the discharge orifices 40 and 42 or bypasses the valve port 62 passing around the valve member 56 and directly out through the discharge orifices 40 and 42. Consequently, discharge of water occurs at all times. Moreover, the bypass flow passage of water operates to lubricate the journals within the housing 36. Water is a well-known lubricant and the presence of water throughout the housing helps reduce the drop in water pressure through the housing 36 and consequently allows the pulsating device to operate effectively and with a faster pulsation rate.

The wheel member 60 of the valve member 56 contains the valve port 62 therein and is located in proximate face-to-face relationship with the top wall of the housing 36 but is a short distance therefrom, leaving an annular space 82 between the wheel member 60 and the upper wall 44. The discharge orifices 40 and 42 are situated in the upper wall 44 of the housing 36, and are arranged in symmetrically spaced groups, at least two of which are different in pattern, which lie within the annular path traversed by the valve port 62. The annular extent of the annular valve port 62 is determined by the number of groups of orifices, the angular extent of the port 62 being equal to 360° divided by the number of groups of orifices or a whole multiple thereof. Because the cross-sectional areas of the individual groups of orifices are substantially equivalent even though the pattern of the orifices within each of the individual groups is different, the number of orifices exposed or covered by the valve port 62 remains substantially constant, regardless of the angular position of the rotating valve port 62. Thus, the back pressure exerted by the relatively restricted discharge orifices remains constant thereby substantially eliminating the possibility of generating a water hammer in the supply system. Moreover, the possibility of generating a water hammer is further diminished by the presence of the annular space 82 between the wheel-like member 60 and the upper wall 44 which serves to permit water to exit the discharge outlet at all times. The rotating valve port 62 uncovers and closes the orifices 40 and 42 in succession as it is driven in rotation, thus intermittently inhibiting the discharge of water through the valve port 62 and out of the discharge orifices 40 and 42, thus producing a pulsating effect in the stream and spray water discharged.

The valve member 56 is formed with the segmentally shaped valve port 62 located so that a portion of one of the two different type discharge orifices 40 and 42 are covered by the valve member 56 at all rotary positions of the valve member 56, while the remaining portion of the one of the two different type orifices 40 and 42 is aligned with the valve port 62. As previously indicated, the teeth 78 of the pinion gear 76 mounted on the impeller 58 are meshed with the teeth of the valve member 56 to kinematically connect the impeller 58 to the valve member 56. As the pinion gear 76 rotates, it drives the valve member 56 so that it rotates in a sense of rotation opposite that of the pinion gear 76.

As can be seen from FIGS. 4–8, there are two discharge orifices 40 and 42, discharge orifice 40 comprising a single aperture and discharge orifice 42 comprising a plurality of smaller apertures, preferably symmetrically grouped about the center of the discharge orifice 42. Water exiting from the single aperture of the discharge orifice 40 breaks into a spray. On the other hand, water exiting from the group of apertures defining the discharge orifice 42 coalesces into a single stream. When the two discharge orifices 40 and 42 are spaced apart from one another a distance of about 0.5 inches, it has been found that the cleansing action of the brush assembly is intensified. The pulsating stream and spray alternately impinge upon the surface of an automobile loosening and/or removing dirt particles embedded or lying thereon. Because of the spacing and configuration of the discharge orifices 40 and 42, the spray and/or liquid stream impinge on the target exterior surface of an automobile in alternative fashion and cooperate with the brushing action of the bristles 16 on the exterior surface of the automobile. The cooperation of the bristles 16 and the pulsating water jet device 24 provide a brush assembly with superior cleansing action than available with the bristles alone or used with separate application of water in a non-pulsating form on the exterior surface of an automobile.

Referring to FIG. 9, there is illustrated an embodiment of the present invention wherein the pulsating water jet discharge device 24 is shown as a part of a nozzle or shower spray head 84. The inlet can be suitably connected to an inlet coupling affixed within the nozzle 84. The flow of water through the discharge orifices provides a pulsating and massaging effect. The discharge orifices should be spaced apart sufficiently to create such effect. If too closely spaced, when the pulses impinge on the skin of a person exposed to the pulsating discharges of water, they feel like a single continuous pulse. If spaced too far apart, the pulses do not provide a massaging effect because the skin springs back too fast from one pulse and is restored to its initial position before an adjacent portion of the skin is struck. A spacing of about 0.5 inches is preferred between the two discharge orifices 40 and 42.

The impeller 58 and the valve member 56 are each one-piece molded members preferably formed from a plastic material. Suitable plastic materials include styrene, polyethylene, polypropylene, polyvinyl chloride, glass-reinforced nylon and nylon.

As various possible embodiments may be made of the above invention and various changes might be made in the embodiments above set forth, it is to be understood that all matter herein described or shown in the accompanying drawings is to be interpreted as illustrative and not in a limiting sense. Thus, it will be understood by those skilled in the art that although preferred embodiments have been shown and described in accordance with the Patent Statutes, the invention is not limited thereto or thereby.

Having thus described the invention, there is claimed as new and desired to be secured by Letters Patent:

1. A brush assembly which comprises:

a brush block member having a face, a multiplicity of bristles mounted on said face and defining a clear space;

a discharge device, said discharge device being situated in said space;

said discharge device comprising a hollow housing, said housing having a first water inlet at one end and means comprising at least two discharge orifices spaced apart from said first inlet in a symmetrical pattern about an axis normal to said face;

a valve member mounted in said housing for rotation about said axis, said valve member having a valve port establishing fluid communication sequentially between said first inlet and one of said orifices, then with portions of both of said orifices, then with the other of said orifices and then with portions of both orifices in a repeating cycle;

means in said housing defining a water flow passage between said first inlet and said valve port for conducting water from said first inlet to said valve port, said water flow passage including a constricted passageway in communication with said first inlet;

a second water inlet situated in said brush assembly and in fluid communication with said first water inlet, said second inlet including means for attachment to a pressurized water line;

turbine means in said housing and situated in said water flow passage immediately downstream of said constricted passageway; and means kinematically connecting said turbine means to said valve member for rotating said valve member in response to the flow of water through said flow passage.

2. A brush assembly as defined in claim 1 wherein a first one of said discharge orifices is defined by a grouping of apertures and a second one of said discharge orifices is defined by a single aperture.

3. A brush assembly as defined in claim 2 wherein said grouping of apertures is symmetrical about the center of said first one of said discharge orifices.

4. A brush assembly as defined in claim 1 wherein said bristles are situated around the perimeter of said face circumscribing said clear space.

5. A brush assembly as defined in claim 2 wherein the cross-sectional area of said two different orifices is substantially equal.

6. A brush assembly as defined in claim 2 wherein said two different discharge orifices are separated a distance sufficient to subject a target of the water jet discharge from said two different orifices to sequentially alternating and/or overlapping impingement of the water jet discharge therefrom.

7. A brush assembly as defined in claim 2 wherein said first-one of said orifices provides a pulsating solid stream of water and said second one of said orifices provides a pulsating spray of water.

8. A brush assembly as defined in claim 1 further including means in said housing defining a second water flow passage between said inlet and said discharge orifices and bypassing said valve port for the conducting of water from said inlet to said discharge orifice.

9. A brush assembly as defined in claim 2 further including means in said housing defining a second water flow passage between said inlet and said discharge orifices and bypassing said valve port for the conducting of water from said inlet to said discharge orifice.

10. A brush assembly as defined in claims 8 or 9 wherein said second water flow passage runs between said outlet along said side walls of said discharge device around said valve member and through the space between the portion of said valve member proximate to said discharge orifices and the wall portion of said discharge device defining said discharge orifices.

11. A brush assembly as defined in claims 1, 2, 8 or 9 wherein said turbine means rotates said valve member at the rate of between about 50 and about 600 revolutions per minute in response to the flow of water at City water pressure through said first flow passage.

12. A brush assembly as defined in claims 1, 2, 8 or 9 wherein said discharge orifices are spaced apart from one another a distance of about 0.5 inches.

13. A brush assembly as defined in claims 1, 2, 8 or 9 wherein said turbine means rotates said valve member at the rate of between about 50 and about 600 revolutions per minute in response to the flow of water at City water pressure through said first flow passage and wherein said discharge orifices are spaced apart from one another a distance of about 0.5 inches.

14. A brush assembly which comprises:

a brush block member having a face, a multiplicity of bristles mounted on said face and defining a clear space;

a discharge device, said discharge device being situated in said space, said discharge device comprising a hollow housing, said housing having a first water inlet at one end and means comprising a discharge orifice spaced apart from said inlet;

a valve member mounted in said housing for rotation about said axis, said valve member having a valve port establishing fluid communication between said first inlet and said orifice and then blocking fluid communication between said inlet and said orifice in a repeating cycle;

means in said housing defining a water flow passage between said first inlet and said valve port for conducting water from said first inlet to said valve port, said water flow passage including a constricted passageway in communication with said first inlet;

a second water inlet situated in said brush assembly and in fluid communication with said first water inlet, said second inlet including means for attachment to a pressurized water line;

turbine means in said housing and situated in said water flow passage immediately downstream of said constricted passageway; and means kinematically connecting said turbine means to said valve member for rotating said valve member in response to the flow of water through said flow passage.

15. A brush assembly as defined in claim 1 further including a pin extending from the exterior of said housing seated within a blind hole in a boss within said space and an annular flange extending from said housing in said annular groove in said space, said pin and said annular flange serving to lockably connect said discharge device to said brush block member.

16. A brush assembly as defined in claim 1 wherein said valve member is rotatably mounted on a first spindle affixed to said housing, said first spindle being situated along said axis of symmetry of said valve member.

17. A brush assembly as defined in claim 1 wherein said turbine means is rotatably mounted on a second spindle affixed to said housing, said second spindle being situated along said axis of symmetry of said turbine means.

* * * * *